United States Patent [19]

Paananen et al.

[11] 4,318,540

[45] Mar. 9, 1982

[54] CONSTANT SPACING DOCUMENT FEEDER

[75] Inventors: Eugene E. Paananen, Brighton, Mich.; Mark S. Casper, Williamsville, N.Y.; Chung H. Peng, Woodhaven, Mich.

[73] Assignee: Burroughs Corporation, Detroit, Mich.

[21] Appl. No.: 111,804

[22] Filed: Jan. 14, 1980

Related U.S. Application Data

[63] Continuation of Ser. No. 942,469, Sep. 14, 1978, abandoned.

[51] Int. Cl.[3] ..... B65H 3/04; B65H 7/18

[52] U.S. Cl. ..... 271/4; 271/34; 271/110; 271/265; 271/270

[58] Field of Search ..... 271/4, 265, 258, 259, 271/270, 34, 35, 110, 111

[56] References Cited

U.S. PATENT DOCUMENTS 4,077,620 3/1978 Frank ..... 271/265 X 4,140,310 2/1979 Schröter ..... 271/265

*Primary Examiner*—Richard A. Schacher

*Attorney, Agent, or Firm*—Charles E. Quarton; Kevin R. Peterson

[57] ABSTRACT

A constant spacing document feeder employs a motor control circuit which drives a feed wheel at an average speed which is dependent upon the length of a document.

Since the spacing between successive documents is a function of the length of each following document, by varying the speed of the feed wheel in accordance with the length of each document, the spacing between each document can be maintained substantially constant.

6 Claims, 3 Drawing Figures

CONSTANT SPACING DOCUMENT FEEDER

This is a continuation of application Ser. No. 942,469, filed Sept. 14, 1978, now abandoned.

BACKGROUND OF THE INVENTION

1. Field of the Invention

This invention relates generally to a document feeding mechanism and in particular to a mechanism which feeds documents at high speed with substantially constant space between documents of intermixed varying lengths.

2. Description of the Prior Art

In many cases document feeding mechanisms provide a space between items which is dependent upon document length, and this space is usually more than that required for the feeding device mechanism to operate efficiently. Since space is wasted in the document path, these feeders are less efficient than ones which provide a constant spacing between items. Some prior art document feeders which provide constant spacing between items utilize complex switching of drive power between rollers. This complex arrangement is sensitive to inaccuracies in alignment and to fatigue resulting from continuous cycling. Accordingly, it is desirable to provide a document feeding mechanism which utilizes a simplified and more reliable constant spacing arrangement.

SUMMARY OF THE INVENTION

The object of the invention is to provide a document feeder which maintains substantially constant spacing between various length documents by means of a variable speed D. C. motor. By providing a constant spacing between documents of various lengths and by maintaining this spacing at a minimum, it is possible to maximize the throughput of a document handling system.

The preferred embodiment of the invention utilizes a hopper where documents are stored prior to feeding, a lead-in belt for gripping the documents and transporting them into a transport path, a feed wheel for driving the lead-in belt, a separator belt for allowing only one document to pass into the transport path while retarding the motion of adjacent documents, and a transport wheel which brings documents to high speed hereinafter referred to as "the transport speed", as soon as, but not before, they are released by the lead-in belt. The transport wheel rotates at the transport speed.

In order to achieve a constant spacing between documents of various lengths, the feed wheel is driven by a D. C. servo motor having an average speed which is proportional to the length of each document. This speed is achieved by a motor control circuit. The space S between two successive documents is given by:

$$S = L\,[(V_{transport}/V_{feed}) - 1]$$

where

L = length of the following document, $V_{transport}$ = speed of transport wheel, and $V_{feed}$ = speed of feed wheel.

Since the space between successive documents, S, is proportional to the length of the following document and inversely proportional to the speed of the feed wheel, by varying the speed of the feed wheel in accordance with the length of the following document, the spacing S can be maintained constant. In general, this is accomplished by feeding a first document with the speed of the transport wheel substantially higher than the feed speed. When the trailing edge of the first document is sensed, a second document is fed initially with the speed of the feed wheel substantially less than the transport speed. After a first predetermined time interval during which the document travels a length equal to the product of feed wheel speed and the predetermined time interval, the speed of the feed wheel is rapidly increased toward the transport speed. The feed wheel accelerates toward this higher speed until either the trailing edge of the second document is sensed, or until a second predetermined time period has elapsed. Ideally, by maintaining the feed wheel at the same speed as the transport wheel (the transport speed) the space between the first document and the second document no longer increases. However, a finite time period is required to accelerate the feed wheel to the transport speed. Thus, during this finite time although the space between the first and second documents increases, the rate of change of the space with respect to time rapidly decreases. As a result, relatively constant spacing is achieved. In order to maximize the throughput of the feeder, the magnitude of the spacing is set as low as possible. The lower limit of this magnitude is determined by the switching speeds of the various document handling devices which utilized after the feeder. A further feature of the invention is that except for when the power to the document feeder is off, the feeder motor is always running. This continuous motion prevents the failures associated with repeated on-off cycling.

The foregoing and other objects, features and advantages of the present invention will become more apparent from the following detailed description of the invention when taken in conjunction with the accompanying drawings.

DESCRIPTION OF THE PREFERRED EMBODIMENT OF THE INVENTION

Figure 1:
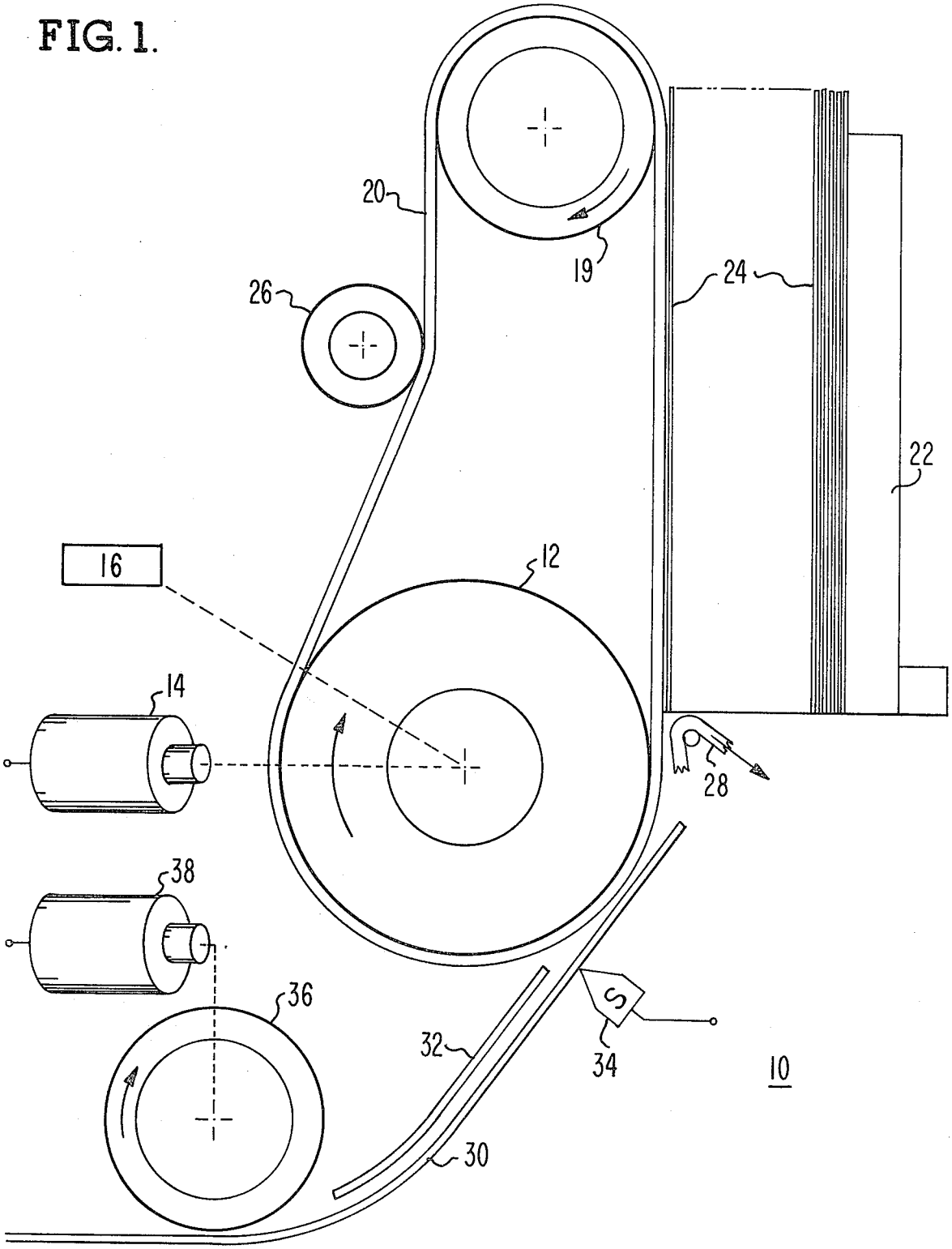
FIG. 1 is a top view of a document feeding mechanism.

Referring to the drawings, in FIG. 1 a document feeding mechanism is shown generally at 10. The document feeding mechanism 10 utilizes a feed wheel 12 which is driven by a D. C. servo motor 14. A tachometer 16 is integrated within the feed wheel 12 to measure the speed of the latter. A first idler pulley 19 together with the feed wheel 12 positions a lead-in belt 20 adjacent to a hopper 22. The hopper 22 holds a stack of documents 24 which are fed toward the lead-in belt 20. A second idler pulley 26 provides the proper tension for the lead-in belt 20.

A separator belt 28 operates to allow only one document to enter the transport path defined by a pair of walls 30 and 32. A document sensor 34 senses the trailing edge of a document as it passes by. A transport wheel 36 near the edge of the transport path is driven by an AC synchronous motor 38 which rotates at the transport speed.

Figure 2:
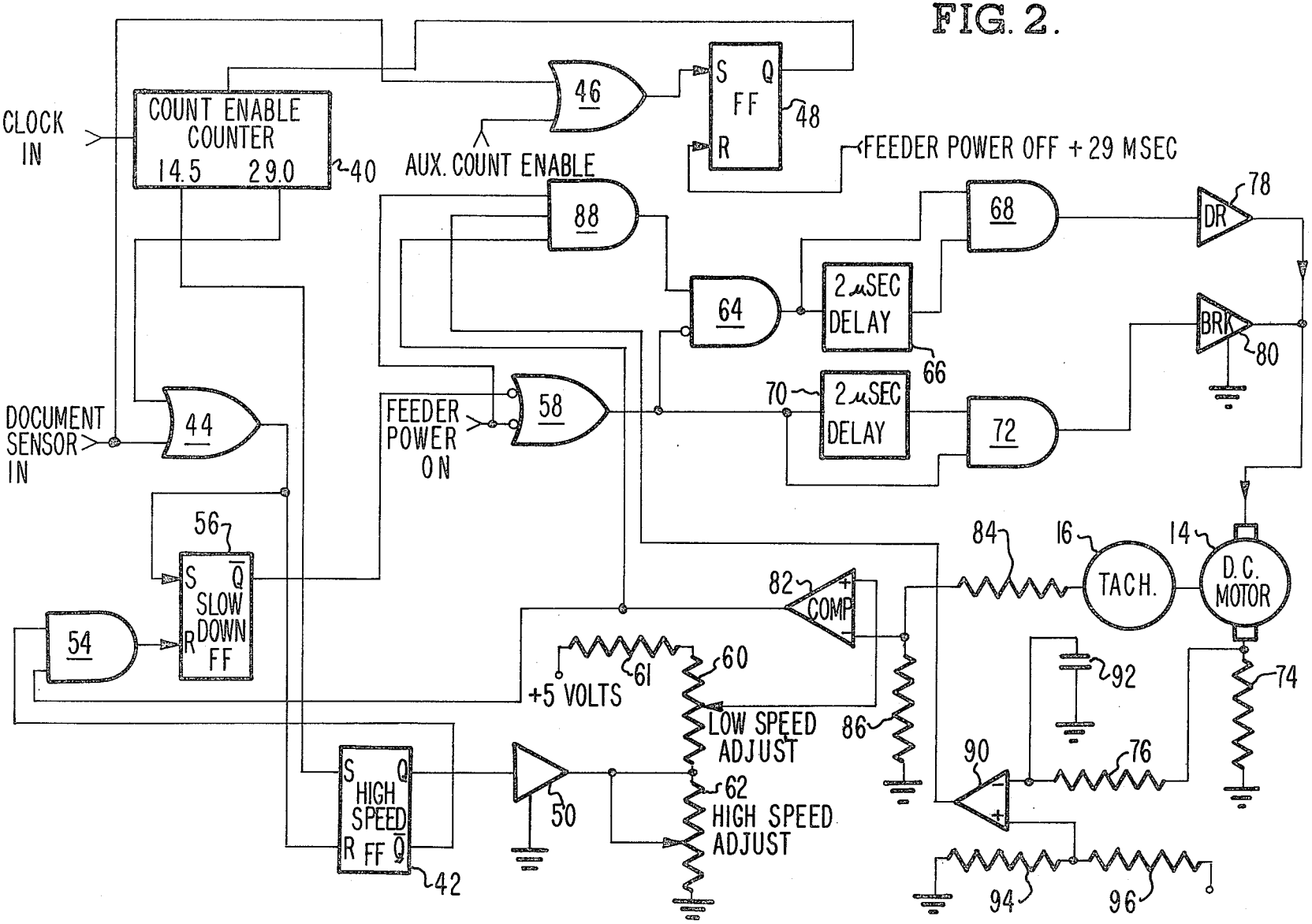
FIG. 2 is a partial block and partial schematic diagram of a preferred embodiment of a motor control circuit for use with document feeding mechanism of FIG. 1.

Referring to FIG. 2, the 14.5 millisecond output of a counter 40 is fed to the set input of a high speed flip-flop 42. The 29 millisecond output of the counter 40 is fed to a first input of an OR gate 44.

A clock signal from an external clock is fed to a clock input of the counter 40. In the preferred embodiment of the invention the external clock operates at a frequency of approximately 5 kilohertz. The output of the document sensor 34 (not shown in FIG. 2) is fed to the junction of a second input of the OR gate 44 and an input of an OR gate 46. The output of the OR gate 46 is fed to the set input of a flip-flop 48. The flip-flop 48 has its reset input connected to a "feeder power off" signal which is delayed by 29 milliseconds and its Q output connected to the count enable input of the counter 40.

The high speed flip-flop 42 has its reset input connected to the junction of the output of the OR gate 44 and the set input of the slow down flip-flop 56, its Q output fed to the input of a drive amplifier 50, and its $\overline{Q}$ output fed to a first input of an AND gate 54. A slow-down flip-flop 56 has its reset input connected to the output of the AND gate 54, and its $\overline{Q}$ output fed to a first input of a NOR gate 58.

The output of the drive amplifier 50 is fed to the junction of a low speed potentimoter 60 a high speed potentimoter 62 and the center arm of the potentimoter 62. The other end of the potentimoter 62 is grounded. The output of an AND gate 64 is connected in common to a delay network 66 and a first input of an AND gate 68. The output of the NOR gate 50 is connected in common to a delay network 70, a first input of an AND gate 72 and a first input of the AND gate 64. The output of the delay network 66 is fed to a second input of the AND gate 68, and the output of the delay network 70 is fed to a second input of the AND gate 72.

The D. C. servo motor 14 is connected between the junction of a pair of resistors 74 and 76 and the junction of the output of a drive amplifier 78 and the output of the brake amplifier 80. The other end of the resistor 74 is grounded. The tachometer 16 is mechanically coupled to the motor 14 to provide an electrical output signal to the negative input of a comparator 82 through a voltage divider consisting of a pair of resistors 84 and 86. The output of the comparator 82 is connected to both an input of the AND gate 54 and a first input of an AND gate 88. The positive input of the first comparator 82 is connected to the center arm of the low speed potentimoter 60. The other end of the potentimoter is connected to an external +5 volt D. C. source through a resistor 61.

The comparator 90 has its negative input connected to the junction of the resistor 76 and a capacitor 92 and its positive input connected to the voltage divider consisting of a pair of resistors 94 and 96. The output of the comparator 90 is fed to a second input of the AND gate 88. The other end of each of the capacitor 92 and the resistor 94 is grounded.

The output of the AND gate 88 is fed to a second input of the AND gate 64. A "feeder power on" signal is fed to the junction of a third input of the AND gate 88 and a second input of the OR gate 58.

Figure 3:
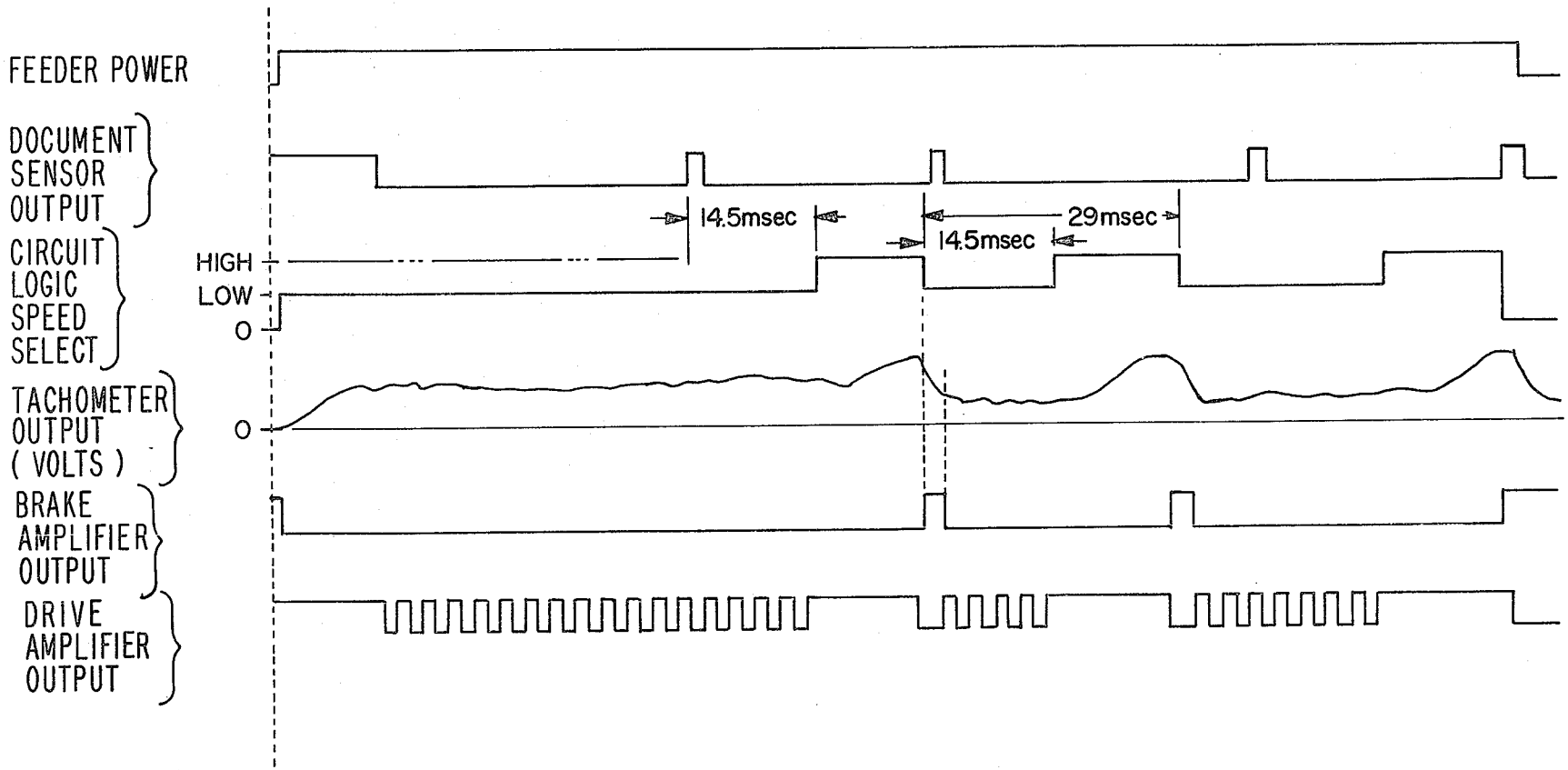
FIG. 3 is a timing chart illustrating the signal device at various points in the diagram of FIG. 2 as a function of time.

Referring to FIGS. 1, 2 and 3, when power is applied to the feeder system, the motor logic circuit operates as a switching regulator to permit the D. C. motor 14 to operate at relatively constant low speed. At the instant power is applied, the output at the AND gate 88 goes HIGH since each of its inputs is HIGH, as will be explained in further detail. Since the output of the AND gate 88 is HIGH, the AND gate 64 is triggered such that its output goes HIGH. The delay network 66 operates together with the AND gate 68 to switch the output of drive amplifier 78 to an ON state after a two microsecond delay. With the output of the drive amplifier 78 switched ON the motor 14 accelerates toward the predetermined low speed. The tachometer 16 senses the speed of the motor 16, and when the motor reaches the predetermined low speed, the output of comparator 82 switches to a LOW state thereby forcing the output of the AND gate 88 to go to a LOW state. During low speed operation of the motor logic circuit, the drive amplifier 50 shorts the high speed potentimoter 62 to ground, thereby making the positive input of the comparator 82 dependent upon the low speed potentimoter 60.

With the output of the AND gate 88 in the LOW state, the output of the AND gate 64 switches to a LOW state, thereby immediately switching the output of the AND gate 68 to the LOW state. Thus, the drive amplifier 78 is switched off thereby permitting the motor 14 to decelerate. Through the tachometer 16, the comparator 82 senses that the speed of the motor is below the desired predetermined level, and switches its output to a HIGH state. This triggers the AND gate 88 thereby switching the output of the AND gate 64 to a HIGH state. The D. C. motor 14 then accelerates twoard the predetermined LOW speed, and the cycle repeats. In the preferred embodiment of the invention the cycle rate is approximately 2 kilohertz. Because of the inertia of the motor 14 and the feed wheel 12, the speed of the motor 14 remains relatively constant throughout the switching process, as shown in FIG. 3.

After the motor 14 has achieved the predetermined slow speed, a first document is gripped by the drive belt 20 and is further moved by the feed wheel 12 into the transport path and is finally accelerated to the transport speed by the transport wheel 36. During the time that this first document is in transport, the predetermined slow speed of the feed wheel 12 is substantially less than the transport speed. When the edge of the first document passes to the document sensor 34, the output of the sensor 34 goes HIGH and triggers both the OR gate 44 and the OR gate 46. The OR gate 46 sets the flip-flop 48 thereby enabling the counter 40. At the same time the OR gate 44 resets the high speed flip-flop 42 thereby forcing the Q output of the flip-flop 42 to the LOW state. Since the Q output of the flip-flop 42 is in the LOW state, the drive amplifier 50 shorts the high speed potentimoter to ground thereby lowering the potential of the positive input of the comparator 82. This insures that the speed of the motor 14 is held at the predetermined low speed.

At the end of a predetermined time period, chosen to be 14.5 milliseconds in the preferred embodiment of the invention, a signal from a first output of the counter 40 triggers the set input of the high speed flip-flop 42. The Q output of the high speed flip-flop 42 goes HIGH and triggers the drive amplifier 50 to thereby insert the high speed potentimoter 62 into the circuit of the comparator 82. At this point the output of the comparator 82 goes HIGH thereby triggering the AND gate 88. The AND gate 88 in turn triggers the AND gate 64, and after a 2 microsecond delay by the delay network 66, the drive amplifier 78 applies a constant D. C. voltage to the D. C. servo motor 14. The motor 14 then accelerates toward the transport speed. In the event that the motor 14 exceeds the transport speed, the comparator 82 operates as a switching regulator.

Since the feed wheel 12 and the transport wheel 36 are now operating near the same high speed, essentially no further spacing between successive documents occurs.

When the trailing edge of the second document passes the document sensor 34, the output of the sensor 34 goes HIGH, triggering the OR gate 44 and thereby resetting the high speed flip-flop 42 and setting the slow down flip-flop 56. The $\overline{Q}$ output of the flip-flop 42 goes HIGH, and the $\overline{Q}$ output of the flip-flop 56 goes LOW thereby triggering the NOR gate 58. The output of the NOR gate 58 triggers the brake amplifier 80 after a 2 microsecond delay, to connect the armature of the D. C. servo motor to ground thereby causing the speed of the motor to rapidly decelerate.

Since the Q output of the high speed flip-flop 42 is in the LOW state, the drive amplifier 50 shorts the high speed potentimoter 62 to ground. Thus, the positive input at the comparator 82 is controlled by the low speed potentimoter 60.

When the motor 14 reaches the predetermined low speed, the output of the comparator 82 goes HIGH thereby triggering the second input of the AND gate 54. Since the first input of the AND gate 54 is in the HIGH state because of the flip-flop 42, this triggering resets the slow-down flip-flop 56 causing the output of the NOR gate 58 to go LOW, thereby releasing the braking action of the flip-flop 64. At the same time the comparator 82 triggers the first input of the AND gate 88 thereby allowing the drive amplifier 50 to provide current to the motor 14.

In the event that no trailing edge of a second or subsequent document is sensed, a second output of the counter 40 automatically triggers the second input of the OR gate 44 as if a trailing edge pulse had done so. In the preferred embodiment of the invention this occurs 29.0 milliseconds after the sensing of the last trailing edge. This feature insures that for documents having an unusually long length, the speed of the motor 14 never exceeds the transport speed.

To prevent the motor 14 from overloading due to jammed documents, the comparator 90 is utilized as a switching device. The resistor 74 develops a voltage across it directly proportional to the current through the motor 14. A resistive-capacitive circuit consisting of the resistor 76 and the capacitor 92 delays the voltage waveform in order to prevent transients from triggering the negative input of the comparator 90. The values of the resistors 94 and 96 are selected to provide a voltage at the positive input of the comparator corresponding to an upper limit of current through the motor 14.

When the current through the motor 14 exceeds a predetermined value, the output of the comparator 90 goes low, thereby insuring that the output of the AND gate 88 is LOW. This prevents the drive amplifier 78 from supplying any current to the motor 14. When the current through the motor 14 does not exceed the predetermined value, the output of the comparator 50 is HIGH, thereby making the output of the AND gate 88 dependent upon its first and third inputs.

When the feeder power is switched off the output of the NOR gate 58 goes HIGH. After a 2 microsecond delay through the delay network 70 the brake amplifier 80 shorts the motor 14 to ground thereby causing the motor 14 to rapidly decelerate. In addition, 29 milliseconds after the feeder power is switched off the flip-flop 48 is reset thereby forcing its Q output to the LOW state. This disables the count enable input of the counter 40 thereby terminating the operation of the motor control circuit.

While the invention has been described with reference to a specific embodiment, it will be understood by those skilled in the art that changes may be made in the form and detail without departing from the scope of the invention.

I claim:

1. A document feeding mechanism for feeding a plurality of documents having variable lengths in a serial stream comprising:

a hopper for storing the documents in a stacked relation adjacent a transport path in the feeding mechanism;

transport drive means for moving documents in a serial stream along the transport path at a transport velocity;

feed drive means for moving documents in a serial stream along the transport path, said feed drive means positioned adjacent said hopper;

sensor means positioned intermediate said feed drive means and said transport drive means for detecting the trailing edge of a document in the transport path;

speed control means for operating said feed drive means at the transport velocity and at a feed velocity, the transport velocity being substantially higher than the feed velocity;

logic means responsive to said sensor means for signaling said speed control means to operate the feed drive means at said feed velocity for a first predetermined time period after said sensor means has detected the trailing edge of a document and then signaling the speed control means to operate the feed drive means at the transport velocity, whereby the space between adjacent documents is increased to a predetermined spacing and said spacing is thereafter maintained substantially constant.

2. The document feeding mechanism of claim 1 wherein said logic means includes sequencing means for signaling the speed control means of said feed drive means to decelerate the feed drive means from the transport velocity to operate the feed drive means at the feed velocity after a document has moved by the feed drive means.

3. The document feeding mechanism of claim 2 wherein said logic means includes a counter for generating said first predetermined time period.

4. The document feeding mechanism of claim 3 wherein the counter generates a second predetermined time period greater than said first predetermined time period;

said sequencing means responding to the occurence of said second predetermined time period for signaling the speed control means of said feed drive.

5. The document feeding mechanism of claim 4 wherein the second predetermined time period is about twice the duration of the first predetermined time period.

6. The document feeding mechanism of claim 5 wherein the second predetermined time period is about 29 miliseconds.

* * * * *